United States Patent [19]

Kwan

[11] Patent Number: 4,600,321

[45] Date of Patent: Jul. 15, 1986

[54] MATRIX PRINT HEAD

[76] Inventor: Okun Kwan, 41 Inca Dr., Trumbull, Conn. 06611

[21] Appl. No.: 698,556

[22] Filed: Feb. 6, 1985

[51] Int. Cl.[4] ..... B41J 3/12

[52] U.S. Cl. ..... 400/124; 101/93.05

[58] Field of Search ..... 400/124; 101/93.05; 335/273–276

[56] References Cited

U.S. PATENT DOCUMENTS

| | | | |
|---|---|---|---|
| 4,214,836 | 7/1980 | Wang | 400/124 |
| 4,230,038 | 10/1980 | Hebert | 400/124 |
| 4,230,412 | 10/1980 | Hebert | 400/124 |
| 4,367,962 | 1/1983 | Gaboardi | 400/124 |
| 4,453,840 | 6/1984 | Hodne | 400/124 |

*Primary Examiner*—Paul T. Sewell

*Attorney, Agent, or Firm*—Parmelee, Bollinger & Bramblett

[57] ABSTRACT

A high speed matrix print head assembly is provided for precisely locating the multiple armatures between the magnetic yoke and print pin of the assembly. An armature guide and supporting spring member is provided having guide slots therein which cooperate with an armature positioning stud protruding through the armature from the armature housing. The armature guide and supporting spring member has a raised longitudinal ridge thereon forming a fulcrum point contact line between the magnetic yoke and the armature guide and supporting spring member to provide a predetermined spring load to the fulcrum point line where the armature pivots. An additional armature spring may provide an additional predetermined spring load. The precise location of the armature and providing a predetermined spring load with the fulcrum line of the armature allows high speed up and down motion of the armature without the interference of other motion. Gap adjustment is also provided by two or four adjustment screws for moving the magnetic assembly with respect to the armatures mounted in the armature housing.

8 Claims, 5 Drawing Figures

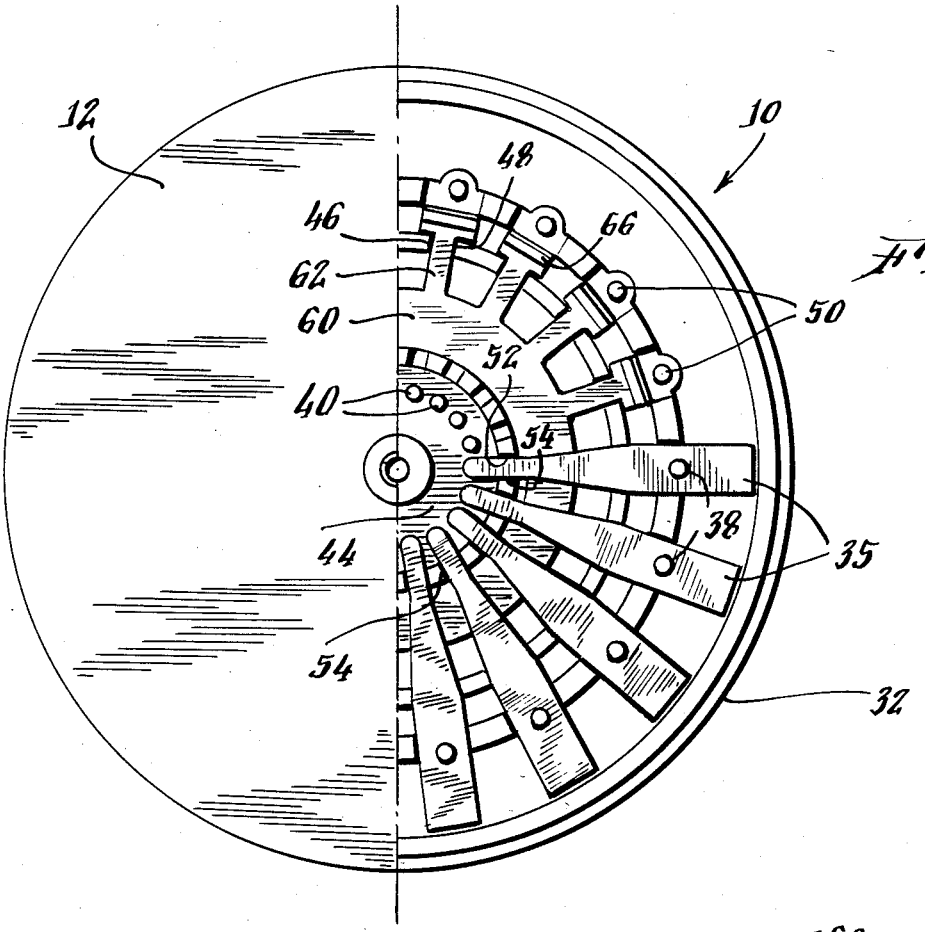
Fig. 3.
Fig. 4
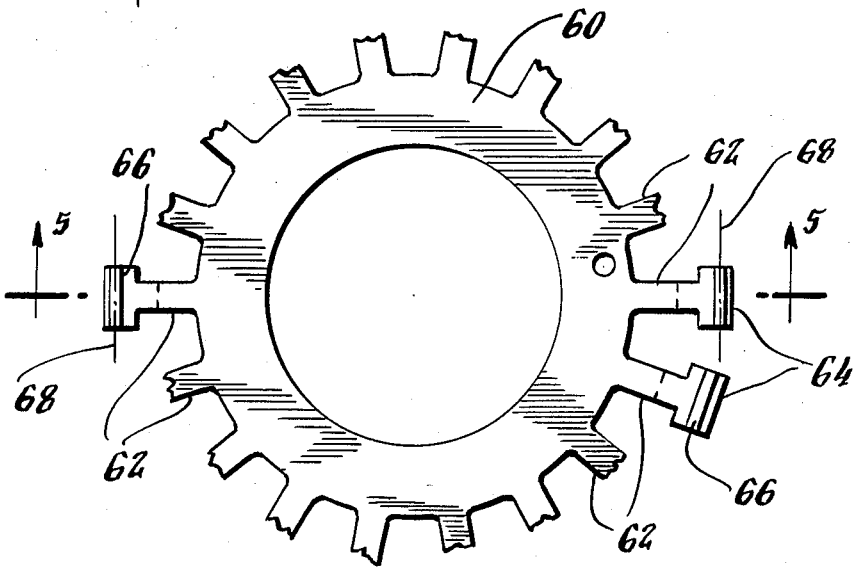
Fig. 5.
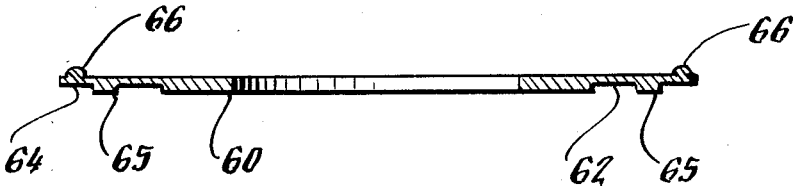

MATRIX PRINT HEAD

BACKGROUND OF THE INVENTION

This invention relates to high speed wire matrix print heads, which accurately locate the armatures of the print head with respect to the print pins and magnetic yokes, and the establishment of a predetermined spring load along a fulcrum point contact line between the magnetic yoke, the armature and its guide and supporting springs. Gap adjustments are also provided in the form of two or four adjustment screws for achieving precise gap adjustment which compensates for any mechanical tolerance buildups in the device.

The present invention in general relates to wire matrix print head assemblies of the type shown in U.S. Pat. Nos. 4,230,038 and 4,230,412. In this type of matrix print head a plurality of print pins are spaced about a central axis and are longitudinally movable thereabout between a print and a non-print position. A plurality of guide means in the form of an armature housing or nose are provided for guidably supporting the print wires or pins and a plurality of armature members which are circumferentially spaced in the armature housing and extend radially outward from the central axis. The armature members have an inner portion engageable with one of the print pins for driving the print pin when actuated on the outer end thereof by a plurality of electromagnetic means each having a magnetic yoke mounted adjacent to the outer portions of the armature for causing pivotal movement of the armature with the outer portion moving toward the electromagnetic means when a magnetic force is applied thereto and the inner portion of the armature striking its associated print pin. In the aforesaid patents the armatures are positioned in a housing which permits free sliding movement therein with the magnetic members being mounted on a one piece housing utilizing a threaded fastening means which can be adjusted to vary the axial air gap between the various magnetic yokes and their associated armatures as well as adjusting the armature movement. In the U.S. Pat. No. 4,230,412 patent the armatures are mounted for free sliding movement in the armature housing and the armatures are pivotally supported on the radially innermost magnetic yoke portions with a resilient O-ring located opposite each yoke which continuously engages the armature and is held in such a position by the armature housing.

SUMMARY OF THE INVENTION

Accordingly, it is an object of the present invention to provide a new and improved high speed matrix print head which is capable of operating with a high speed up and down motion for manipulating the print pins in print and non-print positions without lateral or other interfering armature motion.

A further object of this invention is to provide a new and improved high speed print head with a pivot point for each of the individual armatures occurring along a fulcrum line which is maintained by a predetermined spring load permitting pivotal action while preventing other types of motion which might deter a high speed printing operation.

Still another object of this invention is to provide a new and improved matrix print head which includes a plurality of gap adjustment means providing compensation for any mechanical tolerance buildups which is more likely to occur in a high speed print operation in which precise adjustments in accordance with the present invention provide better performance.

In carrying out this invention in one illustrative embodiment thereof, a high speed matrix print head is provided having a plurality of print pins spaced about a central axis which are longitudinally movable about the axis between a print and a non-print position and a plurality of guide means for guidably supporting the plurality of print pins having a plurality of armature members circumferentially spaced in an armature housing which extend radially outward from the central axis each of which has an inner portion engageable with one of the print pins for driving the print pin when actuated on an outer portion thereof. A plurality of electromagnetic means are provided each having a magnetic yoke mounted adjacent to the outer portions of the armature for causing pivotal movement of the armature with the outer portion moving toward the electromagnetic means when a magnetic force is applied thereto and the inner portion of the armature striking its associated print pin. The improved matrix print head in accordance with the present invention has an armature positioning guide means for each of the armatures in the armature housing for positively locating the armatures in the housing with a minimum of lateral movement therein. Armature guide and supporting means are mounted in the armature housing for precisely establishing a fulcrum contact line for each of the armatures between the armature guide and support means and the magnetic yokes and for providing a predetermined spring load along the fulcrum contact line. The armature guide and supporting spring means includes a first unitary member having a plurality of rounded upper surfaces in the form of longitudinal ridges acting as fulcrum contact lines for the pivotal movement of each of the armatures between the magnetic yokes and the longitudinal ridges and a second member is mounted to the armature housing behind the first member for applying a predetermined spring load to the fulcrum contact line of the first member, and accordingly, to each armature.

The armature positioning and guide means includes a pair of guide slots in the armature housing for each of the armatures flanking the inner portions of the armatures near the print pins, and a plurality of armature positioning studs on the armature housing which are adapted to receive and mount the armatures in the armature housing in proximity of the magnetic yokes on which the armatures are positioned for pivotal movement thereon. In addition, a gap adjustment is provided between the armature housing and the electromagnetic means which includes a spring means, a gap adjustment stud, a shock damper and at least two adjustment screws, and preferably four located 90° apart.

Advantageously, the precisely positioned and located armature and the establishment of a fulcrum point for each armature having a line contact which has a predetermined spring load thereon limits the motion of the armature to a high speed up and down motion while discouraging any type of lateral twisting or other interfering motions of the armature as the print pins are rapidly moved from a print to a non-print position. The gap adjustment compensates a buildup of mechanical tolerance which would otherwise defeat the precise nature of the print operation, and by the compensation of the mechanical tolerance buildups in the print head better performance is provided.

BRIEF DESCRIPTION OF THE DRAWINGS

The invention, together with further objects, aspects, advantages and features thereof will be apparent from the following description taken in connection with the accompanying drawings in which like elements will be designated with the same reference numerals throughout the various views.

FIG. 3 is a partial, top elevational view of the armature housing assembly showing several armatuers positioned therein.

FIG. 4 is a partial, top elevational view of the armature guide and supporting spring means for the print head assembly of FIG. 1.

FIG. 5 is a cross-sectional view taken along line 5—5 of FIG. 4.

DESCRIPTION OF THE PREFERRED EMBODIMENTS

Figure 1:
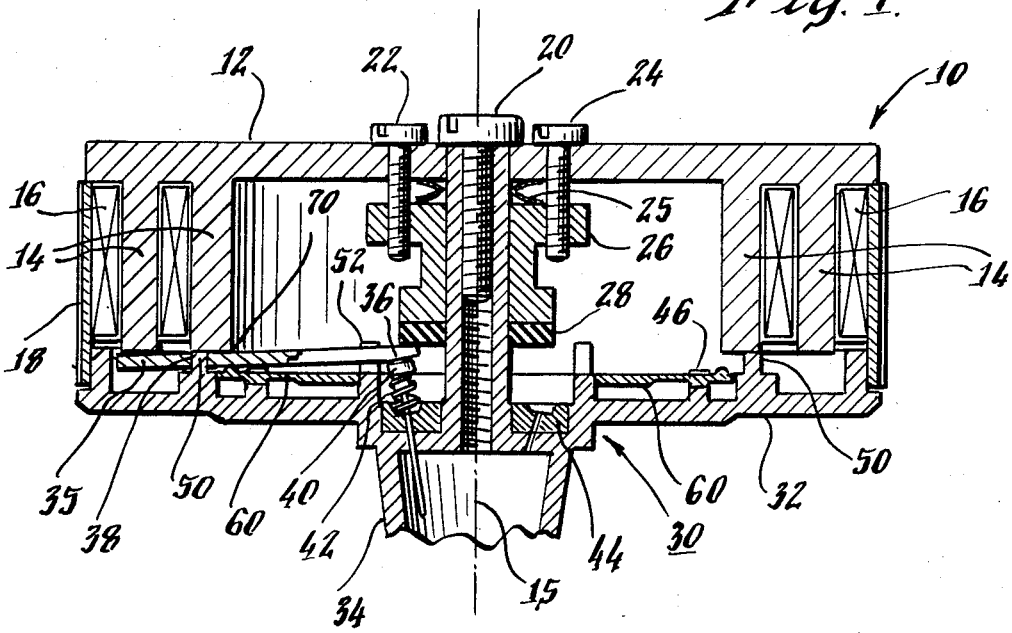
FIG. 1 is a partial, side elevational view in cross-section of the improved high speed matrix print head in accordance with the present invention.
Figure 2:
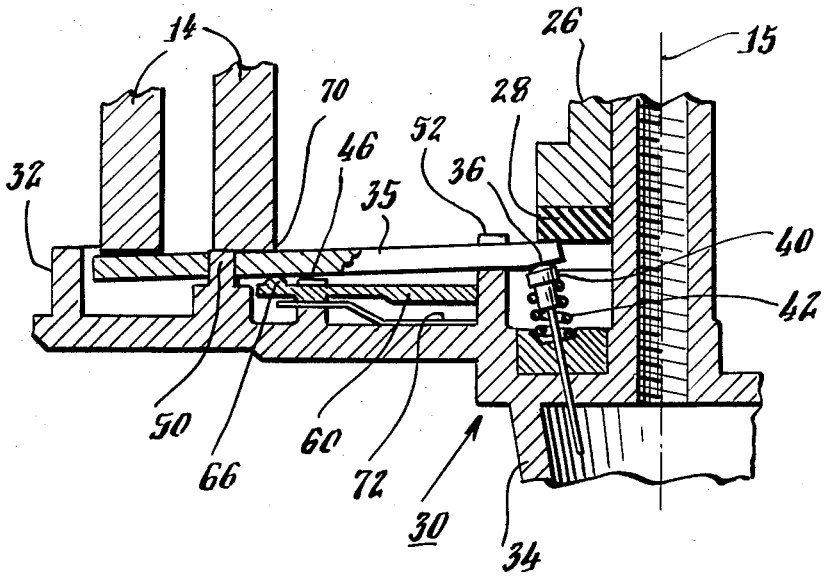
FIG. 2 is an enlarged partial, side elevational view of the matrix print head assembly of FIG. 1.

Referring now to FIGS. 1 and 2, the high speed matrix print head, referred to generally with the reference numeral 10, is divided into two major sub-assemblies, namely, the magnetic assembly 12 and the print pin and armature assembly 30. The mounting screw 20 holds magnetic assembly 12 and the print pin and armature assembly 30 together. The magnetic assembly 12 has a plurality of magnetic yokes 14 circularly disposed about a central longitudinal axis 15. The number of magnetic yokes will correspond to the number of armatures which are employed in the print head. Each magnetic yoke 14 has disposed thereon a coil 16 which is covered by a coil cover 18.

Disposed in quadrature about the screw 20 are four screws 22 and 24 (two of which are not shown) which are attached to a gap adjustment stud 26 having a gap adjustment spring or springs 25 positioned between the stud 26 and the magnetic assembly 12. The gap adjustment spring or springs 25 can be Belleville springs, helical compression springs, special rubber springs, or other types of springs. A shock damper 28 is mounted on the bottom of the gap adjustment stud 26.

The print pin and armature assembly 30 have a unitary armature housing 32 with a nose 34 protruding therefrom which house, align and guide a plurality of print pins, stylii or wires 40. Each print pin 40 is arranged circularly in the nose 34 of the armature housing 32 in a top wire guide bearing 44 and each print pin carries a return spring 42. The armature housing 32 has armature positioning studs 50 circularly disposed in said housing as well as armature guide slots 52 and 54 (see FIG. 3) also circularly disposed around the central longitudinal axis 15 of the print head 10. A plurality of armatures 35 having an angled head 36 are positioned in the armature housing 32 with the innermost portion near the angular head postioned in the armature guide slots 52 and 54 and an armature alignment hole 38 being mounted on the armature positioning stud 50 near the outermost portion of the armature 35 near its pivot point. The purpose of the armature guide slots 52 and 54 as well as the armature positioning stud 50 in the armature housing 32 is to properly and precisely align and position armature 35 in the desired location establishing a predetermined relationship between the print pins 40 and the magnetic yokes 14. The purpose of the angled head 36 of the armature 35 is to provide a substantially 90° relationship between the armature 35 and the head of the print pin 40 so that no component force can be generated during the up and down motion of the print pins between a print and a non-print position.

An armature guide and supporting spring 60 which is illustrated in FIGS. 4 and 5, is a circular member having equally spaced around the central longitudinal axis 15 a plurality of radially extending legs 62 terminating in a foot 64 having a heel 65 and a toe 66. The foot 64 extends longitudinally transverse to its carrying leg 62 and is characterized by being wider than its carrying leg. The armature guide and supporting spring 60 is mounted in the armature housing 32 with the leg 62 being positioned in the radially extending circumferentially spaced slots 46 and 48 (see FIG. 3). When the mounting screw 20 attaches the magnetic structure 12 to the armature housing assembly 30, a predetermined spring load will be applied by toes 66 on the underside of the armatures 35. An additional predetermined spring load may be provided by mounting an armature spring 72 under the heel 65 or the foot 64 of the armature guide and supporting spring 60 which adds an additional predetermined spring load to the underside of the armature 35. The spring 72 may be a flat leaf spring as shown, or may be in the form of a resilient O-ring or other type of spring.

The purpose of the armature guide and supporting spring 60 is to provide a fulcrum point in the form of a line contact between the magnetic yoke 14 and the armature 35 and providing a predetermined spring load along the fulcrum line 70 of the magnetic yoke and armature. As is shown in FIGS. 4 and 5, the armature guide and supporting springs 60 is preferably a unitary molded member in which the toe 66 has a semi-circular shape forming a single contact line 68 with the fulcrum point 70 of the armature 35 on the magnetic yoke 14. The toe 66 could be a triangle with the apex forming a contact line 68 but if a molded piece is utilized, the contact line as provided by the triangle would be more difficult to mold. At any rate, the semi-circular configuration of the toe 66 of the armature guide and supporting spring 60 lines up with the fulcrum point 70 of the magnetic yoke 14 to form a single line contact 68 illustrated in FIG. 4. With the predetermined spring load which is provided by the armature guide and supporting spring 60 and an additional predetermined load as required which is provided by the armature spring 72, a fulcrum line contact is precisely established between the magnetic yoke 14 and the armature guide and supporting spring 60. The purpose of this is to restrict and provide an up and down armature motion which is required for moving the print pin 40 between non-print and print positions with no lateral, twisting, or other interfering motion. The accurately positioned armature as well as the fulcrum contact line established by the armature guide and supporting spring 60 precisely locates a fulcrum line contact which is essential for high speed print operation. The faster the printing, the greater the possibility of buildup of various mechanical tolerances as well as deteriorating printing performance. The 90° relationship between the armature and the print pin 40 prevents component forces from being generated during the print heads up and down motion which further aids in the high speed operation.

With four adjustment screws 22 and 24 spaced 90° apart, a gap adjustment can be provided which is precise and compensates for mechanical buildup in four quadrants of the print head 10. Precise adjustment is required to prevent mechanical tolerance buildups for better performance of the device. In some cases, two adjustment screws spaced 180° apart may be adequate.

The operation of the print pin comprises energizing the coils 16 on the magnetic yokes 14 which pivots the armature 35 about its fulcrum line 70 to strike its associated print pin 40. The print pin 40 strikes an ink media (not shown) which transfers ink to paper in front of a platen (not shown) for generating the desired image. As has been pointed out, the present invention is directed to the establishment of an exact fulcrum line and armature positioning with respect to the rest of the print head structure which pivots that armature so that high speed operation may be achieved. The only motion desired is an up and down pivot motion of the armature 35 to which the present invention is directed eliminating any extraneous motions laterally, twisting or otherwise which causes mechanical buildups and which would deteriorate or prevent the high speed operation of the print head.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following equivalents and claims thereto.

What is claimed is:

1. In a high speed matrix print head having a plurality of print pins spaced about a central axis and being longitudinally movable about said axis between a print and a non-print position, a plurality of guide means for guidably supporting said plurality of print pins, a plurality of armature members circumferentially spaced in an armature housing and extending radially outward from said central axis, each having an inner portion engageable with one of said print pins for driving said print pins when actuated on an outer portion thereof, a plurality of electromagnetic means each having a magnetic yoke mounted adjacent to the outer portions of said armatures for causing pivotal movement of said armature with said outer portion moving toward said electromagnetic means when a magnetic force is applied thereto and said inner portion of said armature striking its associated print head, an improved matrix print head comprising:

armature positioning and guide means for each of said armatures in said armature housing for positively locating said armatures in said housing with a minimum of lateral movement of said armatures in said housing, a unitary armature guide and supporting spring means mounted in said armature housing having a radially extending and circumferentially spaced leg in alignment with each of said armatures, each of said legs having a foot with a longitudinal linear ridge extending upwardly thereon transverse to said radially extending legs, each of said longitudinal linear ridges precisely establishing a fulcrum contact line for said armatures between said armature guide and supporting spring means and said magnetic yokes and providing a predetermined spring load along said fulcrum contact line.

2. The matrix print head as claimed in claim 1, wherein said armature positioning and guide means comprises:

an armature positioning stud on said armature housing for each of said armatures which are adapted to have outer portions of said armature in the proximity of said magnetic yoke positioned for pivotal movement thereon, and a pair of guide slots in said armature housing for each of said armatures flanking the inner portions of said armatures near the print pins which with said positioning studs precisely locates and positions said armature with respect to said magnetic yoke and said print pins for pivotal movement along said fulcrum contact line while limiting any lateral or other movement of said armatures.

3. The matrix print head as claimed in claim 2, wherein said armature has an angled contact head for actuating said print pins at an angle of approximately 90° to limit any component forces in connection with the actuation of said print pins.

4. The matrix print head as claimed in claim 1, wherein said magnetic yoke and electromagentic means form a magnetic assembly, a central mounting means for mounting said magnetic assembly to said armature housing, a gap adjustment stud on said central mounting means positioned over said inner portions of said armatures, spring means mounted between gap adjustment stud and said magnetic assembly, said gap adjustment stud carrying a plurality of gap adjusting screws spaced by at least 90° apart around said central mounting means whereby said gap adjusting screws in cooperation with said gap adjustment spring means provide precise gap adjustment and provide compensation for mechanical tolerance buildups in the print head.

5. The matrix print head as claimed in claim 1, wherein said armature positioning and guide means includes:

an armature positioning stud on said armature housing for each of said armatures having said armatures positioned thereon and radially spaced outwardly from and in the proximity of said longitudinal linear ridges of said armature guide and supporting spring means.

6. In a high speed matrix print head having a plurality of print pins spaced about a central axis and being longitudinally movable about said axis between a print and a non-print position, a plurality of guide means for guidably supporting said plurality of print pins, a plurality of armature members circumferentially spaced in an armature housing and extending radially outward from said central axis, each having an inner portion engageable with one of said print pins for driving said print pins when actuated on an outer portion thereof, a plurality of electromagnetic means each having a magnetic yoke mounted adjacent to the outer portions of said armatures for causing pivotal movement of said armature with said outer portion moving toward said electromagnetic means when a magnetic force is applied thereto and said inner portion of said armature striking its associated print pin, an improved matrix print head comprising:

armature positioning and guide means for each of said armatures in said armature housing for positively locating said armatures in said housing with a minimum of lateral movement of said armatures in said housing, armature guide and supporting spring means for each of said armatures mounted in said armature housing for precisely establishing a fulcrum contact line for said armatures between said armature guide and supporting spring means and said magnetic yokes and providing a predetermined spring load along said fulcrum contact line, said armature guide and supporting means includes a first unitary member having a plurality of rounded upper surfaces in the form of longitudinal ridges acting as the fulcrum contact lines for the pivotal movement of said armatures between said magnetic yokes and said longitudinal ridges, and said armature guide and supporting spring means includes a second member mounted in said armature housing behind said first member for applying an additional predetermined spring load to said fulcrum contact line of said first member.

7. The matrix print head as claimed in claim 6, wherein said armature has an angled contact head for actuating said pins at an angle of approximately 90° to limit any component forces in connection with the actuation of said print pins.

8. The matrix print head as claimed in claim 6 wherein said armature positioning and guide means comprises:

an armature positioning stud on said armature housing for each of said armatures for positioning said armatures in the proximity of said fulcrum contact line, and a pair of guide slots in said armature housing for each of said armatures flanking the inner portions of said armatures near the print pins which with said positioning studs precisely locates and positions said armature with respect to said magnetic yoke and said print pins for pivotal movement along said fulcrum contact line while limiting any lateral or other movement of said armatures.

* * * * *